United States Patent [19]

Wallis

[11] Patent Number: 4,590,788

[45] Date of Patent: May 27, 1986

[54] DIE CLAMP

[76] Inventor: Bernard J. Wallis, 25315 Kean Ave., Dearborn, Mich. 48124

[21] Appl. No.: 657,597

[22] Filed: Oct. 4, 1984

[51] Int. Cl.[4] ..... B21D 37/04

[52] U.S. Cl. ..... 72/481; 72/462; 269/94; 269/229

[58] Field of Search ..... 269/91, 93, 94, 217, 269/229, 230, 231, 232, 235, 238, 240, 244, 245; 72/481, 452, 482, 460, 462

[56] References Cited

U.S. PATENT DOCUMENTS

| | | | |
|---|---|---|---|
| 2,070,380 | 2/1937 | Sunnen | 269/243 |
| 2,271,041 | 1/1942 | Stuckert | 269/94 |
| 2,351,049 | 6/1944 | Kaman | 72/452 |
| 2,627,210 | 2/1953 | Kear | 269/94 |
| 2,690,088 | 9/1954 | Wiglesworth | 269/94 |
| 3,223,407 | 12/1965 | Wills | 269/240 |

OTHER PUBLICATIONS

"Lodding" Inc., May, 1958, Lodding Lever Clamp, top left hand corner.

*Primary Examiner*—Francis S. Husar
*Assistant Examiner*—David B. Jones
*Attorney, Agent, or Firm*—Barnes Kisselle Raisch Choate Whittemore & Hulbert

[57] ABSTRACT

A die clamp adapted to be firmly mounted in a press has a body on which a clamping lever is rockably supported. The lever is rocked to and from a die clamping position by a rotatable cam. A screw connected to the cam by a link is shifted axially by rotating a nut on the clamp to rotate the clamp and thereby rock the lever to and from its clamping position.

15 Claims, 8 Drawing Figures

DIE CLAMP

This invention relates to a clamp for dies.

In a normal stamping press arrangement a die is normally positioned on a base plate fixed to the press and the die is firmly adapted to the base plate by a plurality of clamps around the periphery of the die. Since dies are frequently replaced with other dies, it is desirable to have the clamps readily accessible from the front of the press and designed so that they can be operated easily and quickly to clamp and release a die. In some arrangements it becomes necessary to manually remove the clamps at the front side of the press in order to slide the die into and out of the press. Accordingly, it is important that the clamps be designed to rigidly hold the die, but, at the same time, be relatively light in weight. Experience has shown that fluid-operated die clamps are not always reliable. Mechanical clamps heretofore proposed are frequently cumbersome, of complicated construction and costly to manufacture.

The primary object of this invention is to provide a mechanically-operated die clamp of simple design and of lightweight construction which can be manufactured economically and which is capable of firmly clamping a die in place on a press without the tendency to loosen as a result of vibration of the press.

Other objects, features and advantages of the present invention will become apparent from the following description and accompanying drawings, in which.

Figure 1:
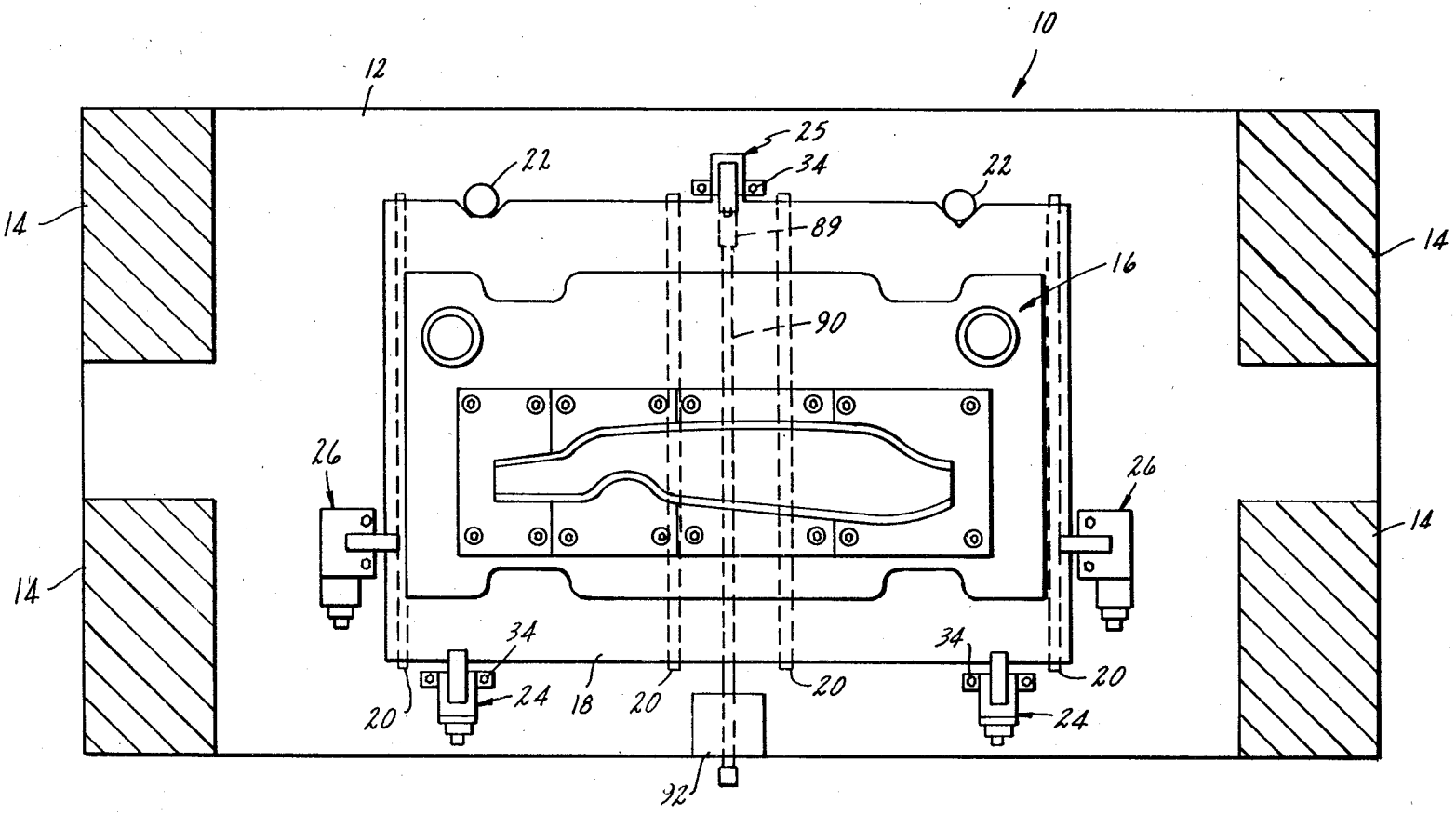
FIG. 1 is a plan view of a die mounted in a press with clamps of the present invention.

In FIG. 1 there is illustrated a press 10 having a bolster plate 12 and upright supports 14 at the four corners of bolster plate 12. A lower die 16 is securely mounted on a bottom die plate 18 which is in turn supported in an elevated position on bolster plate 12 by a series of parallel spacer bars 20 extending between die plate 18 and bolster plate 12 in a direction fore and aft of the press. Pins 22 are used for properly locating the die of the bolster plate. The die is firmly clamped onto bolster plate 12 by a plurality of clamps. In the illustrated embodiment two clamps 24 are arranged at the front side of the die plate 18 and two generally similar clamps 25 are located at the rear side of the die plate adjacent the center thereof. Adjacent the opposite ends thereof the die plate 18 is clamped onto bolster plate 12 by clamps 26 which are of a slightly different construction from clamps 24 as described hereinafter.

The specific construction of clamps 24 is illustrated in FIGS. 2 thru 5. Each clamp includes a clamp body 28 having a flat bottom face 30 which is seated on the bolster plate 12. Body 28 has a pair of apertured ears 32 for receiving screws 34 for firmly attaching the clamps to the bolster plate. Body 28 is formed with a longitudinally extending blind bore 36, the open end of which is closed by a pair of retainer plates 38, each formed with a semi-circular recess for rotatably retaining a hollow nut 40 having a non-circular outer end 42. Body 28 is also formed with a large through cross bore 44 which is perpendicular to and intersects bore 36 adjacent its closed end. Within bore 44 there is arranged a cam 46. Cam 46 comprises a pair of spaced apart circular bearing discs 48 which are journalled in the opposite ends of bore 44. Between discs 48 there is integrally formed therewith a cam segment 50 having cam surface 52 which is formed as a segment of a cylinder, the center of which is eccentric to the central axis of discs 48. The opposite ends of cam surface 52 terminate in radially extending flat surfaces 54,56.

In the space beneath the radially extending surfaces 54,56 there is mounted between the two discs 48, by means of a pivot pin 58, one end of a link 60. The opposite end of link 60 is formed as a clevis and is pivotally connected, as by a pin 62, to the inner end of a screw 64, the opposite threaded end of which is engaged with the internal threads 66 of nut 40. On the top side of body 28 there is machined a channel 68 defined by a pair of spaced apart upright flanges 70. Within channel 68 there is rockably supported, as by a pin 72, a clamp lever 74. The bottom of channel 68 at the axially central portion thereof intersects the upper portion of bore 44 so that the cam segment 50 can project upwardly into the lower portion of channel 68. The end 76 of lever 74 overhangs one end of body 28. The opposite end portion 78 of lever 74 is adapted to be engaged by the cam surface 52.

Figure 2:
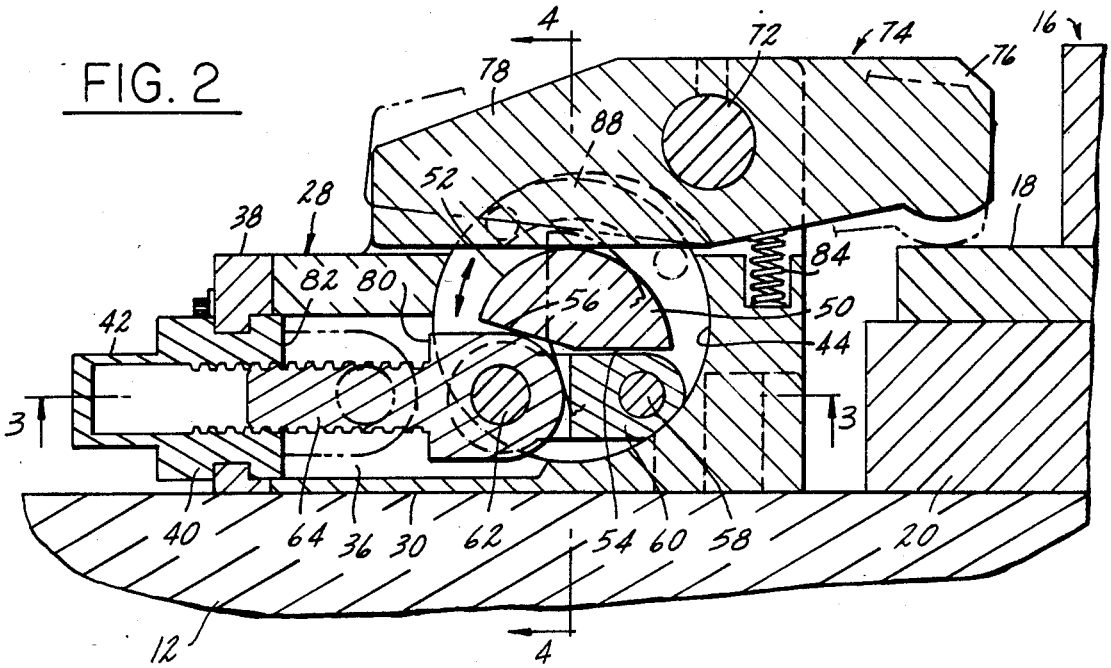
FIG. 2 is a longitudinal sectional view of one form of clamp according to the present invention.
Figure 3:
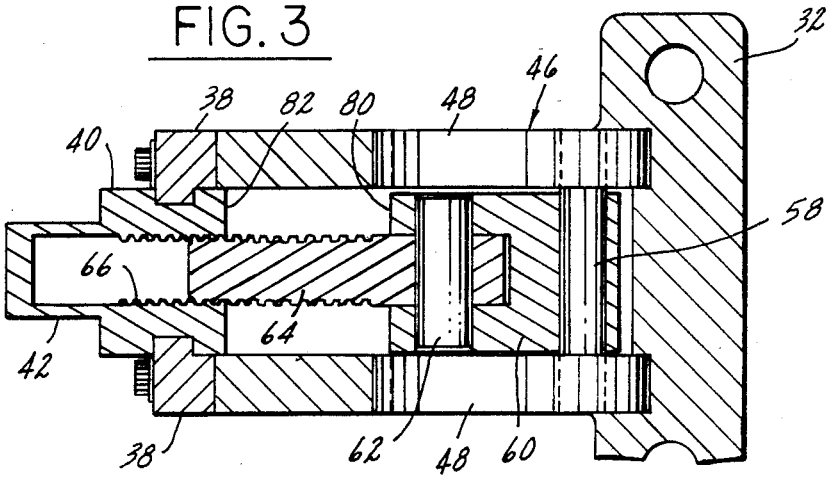
FIG. 3 is a sectional view along the line 3—3 in FIG. 2.
Figure 5:
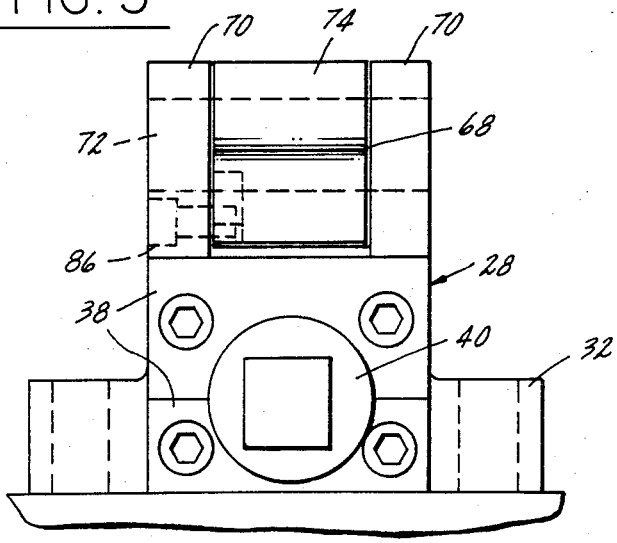
FIG. 5 is a view of the clamp from the actuating end thereof.
Figure 4:
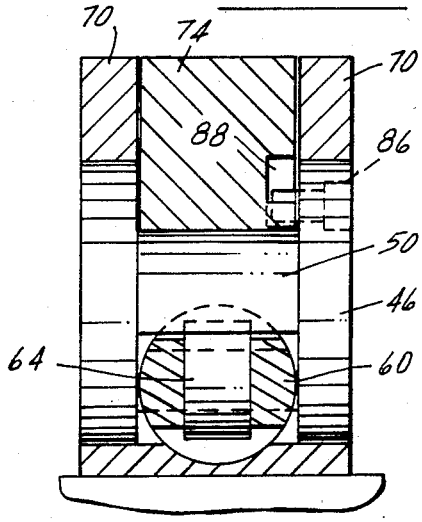
FIG. 4 is a sectional view along the line 4—4 in FIG. 2.

In the solid line position of the clamp components shown in FIG. 2 the clamp is in the released position. The circumferentially central portion of cam surface 52, the portion of this surface which is radially closest to the central axis of discs 48, engages the lower face of the end portion 78 of lever 74. In this position the forward end of link 60 abuts against the surface of bore 44 and limits the extent to which cam segment 50 can be rotated in a counterclockwise direction by nut 42. When nut 42 is rotated in a clockwise direction screw 64 advances into the hollow nut in a direction toward the left as viewed in FIG. 2 and through its connection with link 60 causes the discs 48 and the cam segment 50 to rotate in a clockwise direction. The interengagement of cam surface 52 with the lower face of lever 74 causes the lever to pivot clockwise to the broken line position shown in FIG. 2 wherein the overhanging end 76 of lever 74 is urged downwardly into firm engagement with die plate 18. The maximum travel of cam segment 50 in a clockwise direction is limited by the interengagement of the shoulder 80 with the inner end face 82 of the rotatable nut 40. Under normal conditions the end 76 of lever 74 clamps down against the die plate before shoulder 80 abuts face 82.

A compression spring 84 may be arranged between body 28 and clamping lever 74 for causing the lever to pivot in a counterclockwise direction to the released position when screw 42 is rotated to return the cam segment 50 to the position shown in FIG. 2. If desired, a more positive return action of lever 74 may be obtained by mounting a screw 86 in one of the discs 48 such that its inner end projects into an arcuate groove 88 in the adjacent face of lever 74. Groove 88 is formed so that when cam segment 50 is rotated counterclockwise from the broken line to the full line position shown in FIG. 2 pin 86 engages the groove to forcibly rotate lever 74 to the full line position shown in FIG. 2.

The clamp 25 at the rear side of the die differs from clamps 24 only in that the locking lever 74 is reversed on body 28; it overhangs nut 40. The non-circular end 42 of nut 40 is coupled, as at 89, to a shaft 90 (FIG. 1) which extends forwardly under die plate 18 to the front side of bolster plate 12 where it is supported for rotation as by a block 92. This enables clamp 25 to be manually actuated from the front side of the press.

The clamps 26 at each end of die plate 18 differ only slightly in construction from the clamp illustrated in FIGS. 2 thru 5. Each clamp 26 comprises a body 94 having a blind bore 96 extending inwardly from one side thereof. The discs 48 of cam 46 are seated in the opposite ends of bore 96. Nut 40 is supported for rotation on body 94 by a pair of retainers 98 which are secured to body 94 by screws 100. The screw 64 engaged with nut 40 extends axially through a bore 102 in retainers 98 and body 94 which is perpendicular to and intersects bore 96. Screw 64 is connected to link 60 which is in turn connected to cam 48 in the same manner as shown and described in connection with FIGS. 2 thru 5.

On the top side of body 94 there is machined a slot 104 in which a clamping lever 106 is supported for rocking movement by means of a pin 108 extending through the two ears 110 between which the slot 104 extends. In a manner similar to the previous embodiment described, the lower portion of slot 104 intersects bore 96 so that the inner end portion 112 of lever 106 bears against the cam surface 52 of the cam segment 50. It will be noted, however, that unlike the previous embodiment described, in the clamp shown in FIGS. 6 thru 9 the pivot axis 108 of lever 106 is perpendicular rather than parallel to the axis of rotation of cam 46. Thus, as shown in FIG. 1, clamps 26 can be arranged so that they can be operated from the front side of the press.

Figure 6:
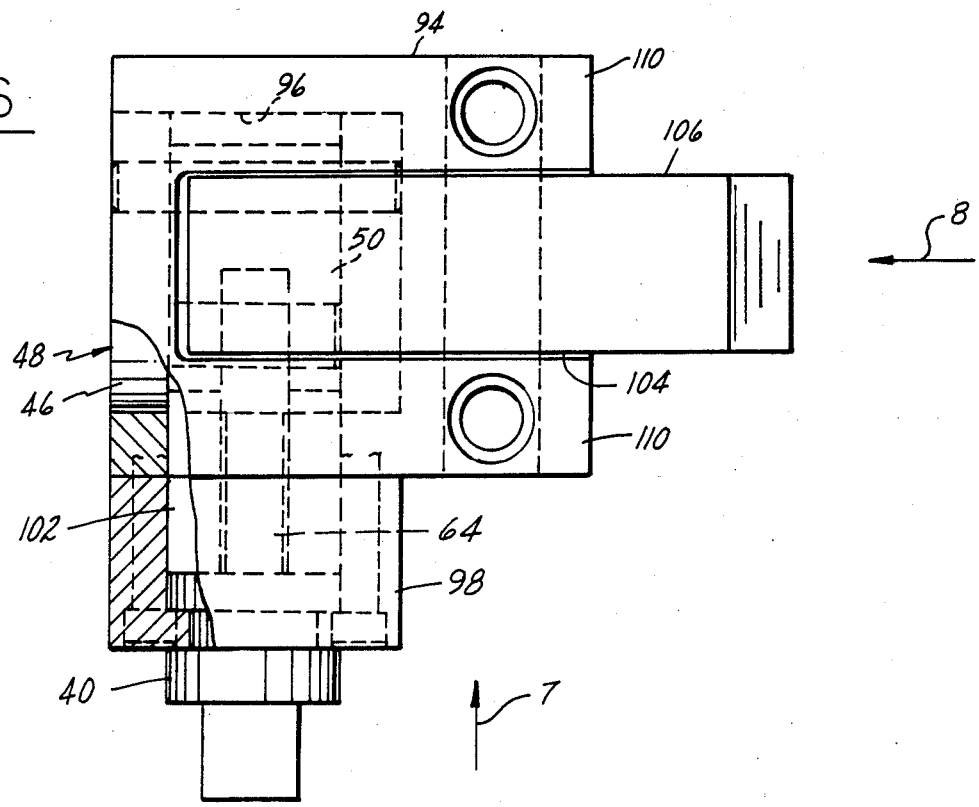
FIG. 6 is a top plan view of another form of clamp according to the present invention.
Figure 7:
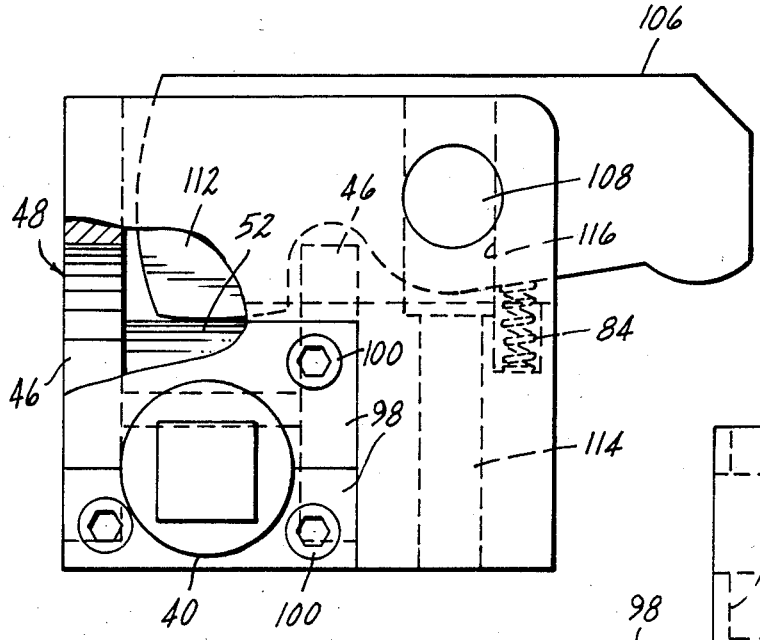
FIG. 7 is a view of the clamp shown in FIG. 6 taken in the direction of the arrow 7 with FIG. 6 with parts broken away.
Figure 8:
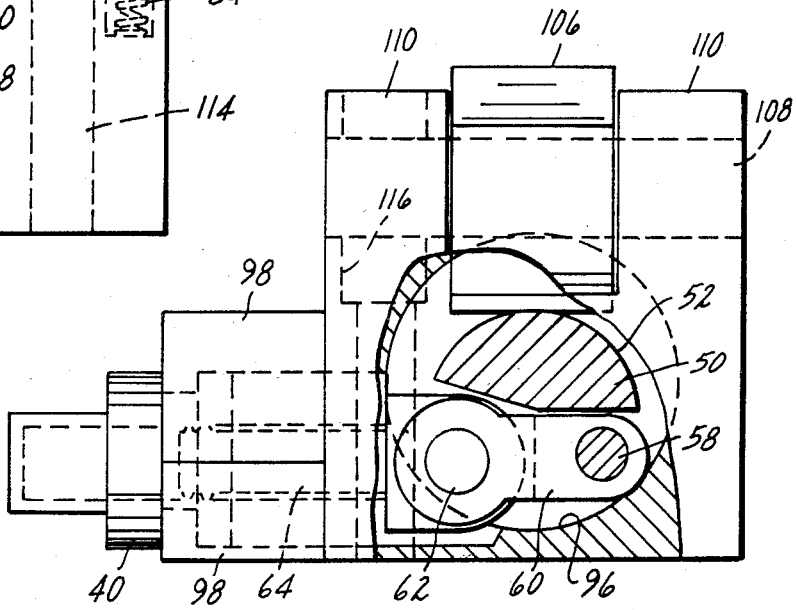
FIG. 8 is a view of the clamp shown in FIG. 6 in the direction of the arrow 8 in FIG. 6 with parts broken away.

Body 94 is also formed with a pair of vertical through openings 114 for accommodating hold-down screws for mounting the clamp on the bolster plate of the press. In order to maintain the body 94 of the clamp relatively small the holes 19 are aligned with pin 108. However, the upper ends of holes 114 are formed with a deep counterbores 116 so that the heads of the holding screws will be disposed below the opposite ends of pivot pin 108. If desired, the return spring 84 may be utilized for rocking lever 106 to the released position when screw 40 is rotated in a counterclockwise direction. Except for the fact that clamp lever 106 rocks about an axis perpendicular to the axis of rotation of cam 46, the operation of the clamp shown in FIGS. 6 thru 8 is the same as that shown in FIGS. 2 thru 5.

It will observed that both forms of clamps consist of only a few simple components that can be readily machined without the use of sophisticated machines or tooling. The fact that the clamps are relatively small, but very sturdy, can be easily machined and do not employ gears, racks and other costly components renders them very economical. Furthermore, if it becomes necessary to remove the two front clamps 24 in order to remove or replace a die, the size and weight of these clamps enables this to be done easily and in a simple manner.

I claim:

1. A die clamp comprising a body, a rotatable cam journalled in said body and having an arcuate cam face, a clamping lever pivotally supported intermediate its ends for rocking movement on said body, said lever having one end portion overhanging one end of said body for clamping against a die, the opposite end portion of the lever engaging said cam face so that when the cam is rotated in one direction said lever is rocked to the die-clamping position, a link having a pivot connection at one end with said cam at an axis fixed on the cam and spaced from and parallel to the axis on which the cam is journalled, a nut member and a screw member, one of said members being axially fixed and journalled for rotation on said body about an axis perpendicular to the axis on which the cam is journalled, the other member being in threaded telescopic engagement with said one member and being pivotally connected to the other end of said link.

2. A die clamp as called for in claim 1 wherein said one member has a non-circular end portion projecting outwardly from said body for engagement with a manually operable turning tool.

3. A die clamp as called for in claim 2 wherein said one member comprises said nut and the other comprises said screw.

4. A die clamp as called for in claim 2 wherein said one member projects from the end of said body opposite the end which the lever overhangs.

5. A die clamp as called for in claim 2 wherein the journal axis of the cam and the pivot axis of the lever are perpendicularly related.

6. A die clamp as called for in claim 1 wherein said body has a pair of axially opposed circular bearing seats, said cam comprising a central cam member having a pair of axially aligned bearing discs on opposite sides thereof journalled in said circular bearing seats.

7. A die clamp as called for in claim 6 wherein said discs have a larger radius than the maximum radius of said cam surface.

8. A die clamp as called for in claim 6 wherein said cam surface is defined by a segment of a cylinder, the axis of which is offset from the axis of said discs.

9. A die clamp as called for in claim 6 wherein said cam surface comprises an arcuate segment extending partially around the journalled axis of the cam, the pivotal connection between said link and cam comprising a pin connected to and extending between the two discs, said pin being disposed in the space between the opposite ends of said cam surface.

10. A die clamp as called for in claim 9 wherein the circumferentially opposite ends of the cam surface comprise a pair of radially extending surfaces which define an open slot between said discs, said link being disposed in said slot.

11. A die clamp as called for in claim 1 wherein said body comprises a metal block having a first bore extending inwardly from one side thereof and a transverse bore intersecting said first bore and extending inwardly from another side of the body, said cam comprising a central cam member having a pair of axially aligned bearing discs on opposite sides thereof, said discs being of larger diameter than said cam member, said discs being journalled in the opposite ends of said second bore, said cam member being disposed at the intersection of the two bores and said screw being connected to said link and extending longitudinally in the first bore.

12. A die clamp as called for in claim 11 wherein said first bore is a blind bore which terminates adjacent the intersection of the two bores.

13. A die clamp as called for in claim 11 wherein said nut member is journalled on said body and has an annular groove therein, a pair of abutting retainer plates on said body closing the open end of said first bore, said retainer plates having circumferentially registering semi-circular openings in adjoining edges thereof which interengage with said annular groove to retain said last-mentioned threaded member in axially fixed position on said body.

14. A die clamp as called for in claim 11 wherein said link is adapted to engage a surface portion of said second bore to limit rotation of the clamp in one direction.

15. A die clamp as called for in claim 11 wherein said body has a pair of laterally spaced integral flanges projecting upwardly from top side thereof and defining therebetween a slot, said second bore intersecting the lower portion of said slot, said lever being rockably supported in said slot and said cam surface projecting upwardly into said slot for engagement with the bottom of the lever when the cam is rotated in the die clamping direction.

* * * * *